US009944434B1

(12) United States Patent
Beauregard et al.

(10) Patent No.: US 9,944,434 B1
(45) Date of Patent: Apr. 17, 2018

(54) HYGIENIC SPONGE HOLDER

(71) Applicant: Family Innovators B&F, LLC, Manchester, MA (US)

(72) Inventors: Cynthia Ann Beauregard, Manchester, MA (US); Edward Joseph Beauregard, Manchester, MA (US); Craig Edward Beauregard, Quincy, MA (US); Bethany Marie Fleming, Tewksbury, MA (US); James William Fleming, Tewksbury, MA (US)

(73) Assignee: FAMILY INNOVATORS B&F, LLC, Manchester, MA (US)

( * ) Notice: Subject to any disclaimer, the term of this patent is extended or adjusted under 35 U.S.C. 154(b) by 21 days.

(21) Appl. No.: 14/716,223

(22) Filed: May 19, 2015

Related U.S. Application Data

(60) Provisional application No. 62/000,784, filed on May 20, 2014.

(51) Int. Cl.

| | |
|---|---|
| ***B65D 83/10*** | (2006.01) |
| ***B65D 25/04*** | (2006.01) |
| ***B65D 25/38*** | (2006.01) |
| ***B65D 85/00*** | (2006.01) |
| *A47K 10/06* | (2006.01) |
| *A47K 10/12* | (2006.01) |

(52) U.S. Cl.
CPC ..... *B65D 25/04* (2013.01); *B65D 25/38* (2013.01); *B65D 85/70* (2013.01); *A47K 10/06* (2013.01); *A47K 10/12* (2013.01)

(58) Field of Classification Search
CPC ..... B65D 25/04; B65D 25/38; B65D 85/70; A47K 10/06; A47K 10/12
See application file for complete search history.

(56) References Cited

U.S. PATENT DOCUMENTS

| | | | | |
|---|---|---|---|---|
| 1,534,259 A * | 4/1925 | Dempsey | B24D 15/00 | 15/209.1 |
| 2,233,157 A * | 2/1941 | Hermann | A45F 5/04 | 132/286 |
| 3,642,499 A * | 2/1972 | Castell | B65D 25/04 | 206/459.5 |
| D252,312 S * | 7/1979 | Ackeret | D7/503 | |
| 4,275,970 A * | 6/1981 | Morrison | A01G 1/00 | 15/244.2 |
| D273,652 S * | 5/1984 | Lederman | D7/539 | |

(Continued)

*Primary Examiner* — Steven A. Reynolds
*Assistant Examiner* — James Way
(74) *Attorney, Agent, or Firm* — BainwoodHuang

(57) ABSTRACT

Techniques of transporting bath sponges involve holding a used bath sponge in a case that will carry and compress the used bath sponge. Such a case separates the soiled water and debris that is drained from the used bath sponge. The case is designed to facilitate the drainage of water and debris that have accumulated in the bath sponge after it is used. The action of compression of a bath sponge within this case will also help to maintain the original shape of the bath sponge. This case will keep all water and debris that has collected by the action of compression of the bath sponge contained in the lower sections of the case. In addition, when this case is stored in an upright position, the water and debris will not be able to flow back into the top section where the sponge is being stored.

14 Claims, 7 Drawing Sheets

(56) References Cited

U.S. PATENT DOCUMENTS 4,752,147 A * 6/1988 Persi ..... B05C 17/00 401/123
4,793,517 A * 12/1988 Washut ..... A47K 5/1211 222/129
4,854,449 A * 8/1989 Fitzhugh ..... A44B 15/005 15/214
5,009,327 A * 4/1991 Levison ..... A47K 10/24 206/361
5,085,330 A * 2/1992 Paulin ..... A47G 19/2272 215/387
5,575,848 A * 11/1996 Chedville ..... A47J 43/04 118/13
5,871,116 A * 2/1999 Picchietti ..... A45C 11/20 220/4.24
6,135,307 A * 10/2000 Fahy ..... A47G 19/02 220/521
6,237,880 B1 * 5/2001 McNutly ..... A47B 81/02 206/209
D507,939 S * 8/2005 Mitchell, Jr. ..... D7/629
6,942,412 B2 * 9/2005 Gueret ..... A45D 34/045 401/123
D511,642 S * 11/2005 Riddell ..... D7/356
7,487,881 B2 * 2/2009 Watzke ..... B65D 1/24 220/501
7,597,495 B2 * 10/2009 Gueret ..... A45D 34/04 401/130
D613,131 S * 4/2010 Chen ..... D7/356
7,866,183 B2 * 1/2011 Roth ..... A47J 36/2416 62/457.3
8,016,150 B1 * 9/2011 Bunch ..... A47J 37/1271 220/23.87
8,142,095 B1 * 3/2012 Cutler ..... A47K 7/03 401/201
8,240,503 B2 * 8/2012 Curtin ..... A47J 47/10 220/501
8,485,378 B2 * 7/2013 Zoss ..... A47G 19/02 206/219
8,574,647 B1 * 11/2013 Gunderson ..... B65D 25/04 206/514
8,887,665 B2 * 11/2014 Rocker ..... A01K 5/0128 119/61.2
8,985,377 B2 * 3/2015 Lane ..... A47J 31/18 206/5
9,192,279 B1 * 11/2015 Valle ..... A47L 13/51
2005/0199622 A1 * 9/2005 Radow ..... A47G 19/22 220/4.27
2007/0075268 A1 * 4/2007 Harris ..... A61L 2/10 250/455.11
2008/0078200 A1 * 4/2008 Roth ..... A47J 36/2416 62/457.4
2009/0194138 A1 * 8/2009 Burns ..... A47L 13/16 134/59
2010/0329924 A1 * 12/2010 Harris ..... A61L 2/10 422/5
2012/0024812 A1 * 2/2012 Underwood ..... A45F 3/16 215/6
2014/0239783 A1 * 8/2014 Dordan ..... A47L 25/00 312/228.1
2015/0050405 A1 * 2/2015 Trager ..... B65D 81/3211 426/519
2015/0136618 A1 * 5/2015 Patel ..... A24F 23/00 206/0.5
2015/0336718 A1 * 11/2015 Dwyer ..... A62B 18/006 128/205.12
2016/0066749 A1 * 3/2016 Trager ..... A47J 43/27 206/222
2016/0273789 A1 * 9/2016 Gwen ..... F24F 3/1411

* cited by examiner

HYGIENIC SPONGE HOLDER

PRIORITY

This application claims priority from U.S. Provisional Patent Application No. 62/000,784 entitled "Plastic carrying travel container for Bath sponge and or body wash/soap applicator. The plastic case will compress and drain the bath sponge. The case is designed for both home and travel use. The product name is Scrub on the Run" filed on the behalf of Cynthia Ann Beauregard, Edward Joseph Beauregard, Craig Edward Beauregard, Bethany Marie Fleming, and James William Fleming on May 20, 2014.

TECHNICAL FIELD

This application relates generally to an accessory for any type of bath sponge that is typically utilized to apply body wash, soap, or lotion.

BACKGROUND

Bath sponges are typically transported for travel and use away from home by consumers in a variety of ways. A conventional approach to transporting bath sponges involves using a plastic zip lock bag to transport their bath sponge. Another conventional approach involves transporting a used bath sponge wrapped in a bath towel.

SUMMARY

Unfortunately, there are deficiencies in the above-described conventional approaches to transporting bath sponges. For example, a sponge is not separated from the water and debris that are present after usage. This presents a potentially non-hygienic environment. Along these lines, transporting bath sponges in plastic bags allows the bath sponges to remain wet as it sits in soiled bath water. Such bath sponges tend to build up bacteria.

In addition, carrying a wet bath sponge in this manner can also be a potential leaking hazard if the zip lock bag opens during the transporting process. Further, the water and debris can transfer to other items in a suitcase or gym bag in which the sponge is carried.

Also, some consumers who store their sponges in a bath towel may accidently put their bath sponge in the washer or dryer as it is hidden in the bath towel. The washing and drying of a bath sponge may result in abrasive or frayed edges making the bath sponge unsuitable for use.

Another issue with bath sponges is that they lose their shape and uniformity over time as they are used. As the bath sponge loses its original shape they become less effective at applying body wash, soap or lotion. This can also create unnecessary wasting of body wash or lotions.

In contrast to the conventional approaches which may give rise to non-hygienic environments, improved techniques of transporting bath sponges involve holding a used bath sponge in a case that will carry and compress the used bath sponge. Such a case separates the soiled water and debris that is drained from the used bath sponge. The case is designed to facilitate the drainage of water and debris that have accumulated in the bath sponge after it is used. The action of compression of a bath sponge within this case will also help to maintain the original shape of the bath sponge. This case will keep all water and debris that has collected by the action of compression of the bath sponge contained in the lower sections of the case. In addition, when this case is stored in an upright position, the water and debris will not be able to flow back into the top section where the sponge is being stored.

In some arrangements, the case has three parts. A top section of the case will hold and aide in the compression of the bath sponge. A middle section will facilitate compression by driving up into the top section. The middle section will also facilitate drainage by diverting liquid and debris to the lower section through a round opening with a funnel design. A bottom section will serve as a base. The base may enclose the case and hold water and debris when the case is placed upright. In a typical application a bath sponge would be placed into the top section of the case and can either be hung on a hook in a shower or bathtub by the hanging loop design on the top of the upper part of the case. This action allows the bath sponge to be compressed and drain excess water and debris. The action of continuous compression also allows the sponge to maintain its original shape. When the consumer wants to take the bath sponge with them when traveling or at the gym, the middle and lower sections can be assembled together and attached to the top section by pushing or driving the middle section into the top section and screwing all sections together. Once fully assembled the case can be either hung on the outside of any travel bag by the hanging loop or it can be stored in any carrying case or suitcase. If it is most important for a consumer to have a case made of a precious metal material, the case can be made of this type of material. If having a smaller bath sponge is most important to a consumer this case can also be made in a smaller size. The case may be impregnated with an antimicrobial substance to inhibit bacterial growth.

Advantageously, the improved techniques provide a convenient, portable, and hygienic way for consumers to carry and or transport the bath sponge. This case provides a convenient way to carry a bath sponge and also provide a hygienic solution by separating the water, bacteria, and debris. This case helps the bath sponge to maintain its original shape and make it more effective for application of body wash, soap, or lotion.

One embodiment of the improved techniques is directed to a sponge holding apparatus. The sponge holding apparatus includes a housing that defines a sponge holding space to hold a sponge over a sponge draining space. The sponge holding apparatus also includes a separator that couples to the housing, the separator being constructed and arranged to separate the sponge holding space from the sponge draining space.

Additionally, some embodiments are directed to a method of manufacturing a sponge holding apparatus. The method includes defining, within a housing, a sponge holding space to hold a sponge over a sponge draining space. The method also includes providing a separator to separate the sponge holding space from the sponge draining space using a separator that couples to the housing.

BRIEF DESCRIPTION OF THE DRAWING

The foregoing and other objects, features and advantages will be apparent from the following description of particular embodiments of the invention, as illustrated in the accompanying figures in which like reference characters refer to the same parts throughout the different views.

DETAILED DESCRIPTION

In the following discussion, numerous specific details are set forth to provide a thorough understanding of the present invention. However it will be clear to those skilled in the art that the present invention may be practiced without such specific details.

Figure 1:
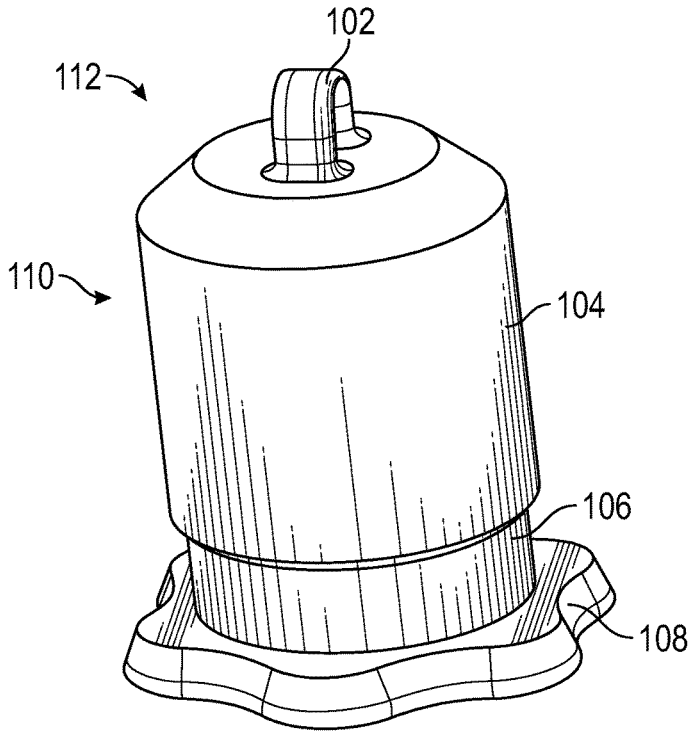
FIG. 1 illustrates a view of an example sponge holder apparatus according to the improved techniques.

In accordance with the improved techniques, and as described in further detail below, an example container for transport and storage of a bath sponge includes three sections. Included in the three sections is a top section, or sponge holding space 110, a middle section or separator 106, and a bottom or base 108. As exemplified in FIG. 1 of the drawings the three sections are assembled to create an enclosed unit.

Figure 2:
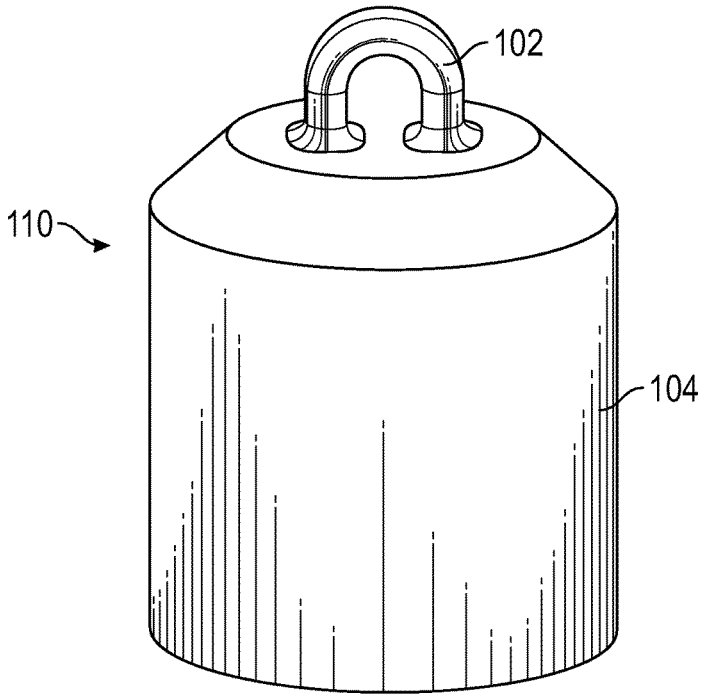
FIG. 2 illustrates a frontal view of the top housing section of the sponge holder apparatus.

As viewed in FIG. 2, the top section 110 includes a housing unit 104 with the intended purpose of holding a bath sponge 1006. The shape of the housing 104 will allow a bath sponge to be compressed. The act of compression allows water and debris to be expelled from the bath sponge. The housing 104 also aids in the maintenance of the bath sponge form and/or original shape by the act of continuous compression of the bath sponge as it is being stored in the housing 104.

Figure 3:
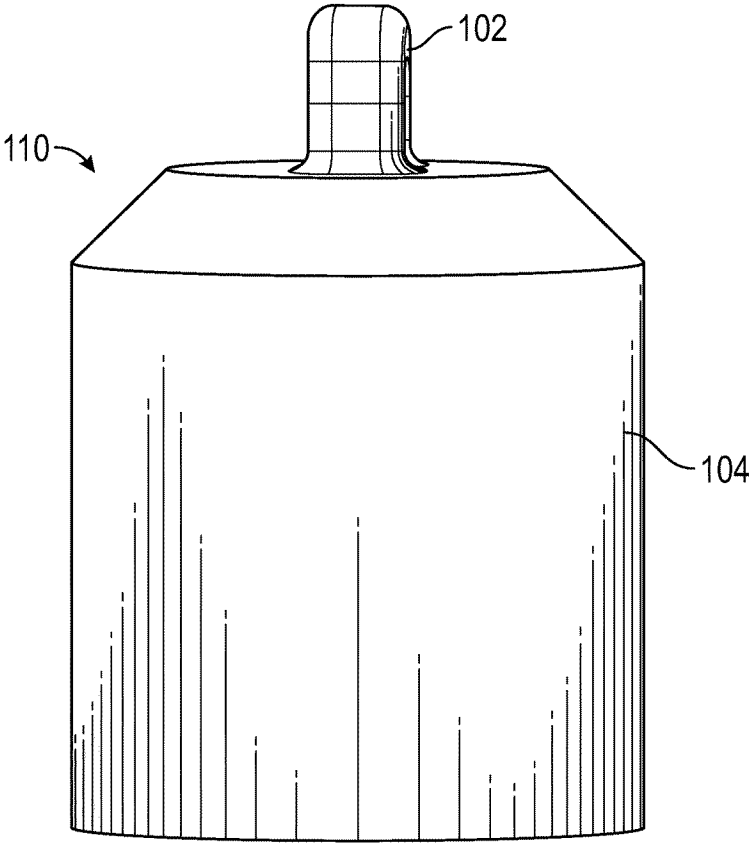
FIG. 3 illustrates a lateral/side view of the top housing section of the sponge holder apparatus.

Referring to FIG. 3, the sponge holding space 110 of the present invention has an appendage extending from the top of sponge holding space 110. The appendage has a hollow loop assembly 102 with an intended purpose of hanging the present invention on a peg or holder in a shower and or bathtub area. This aforementioned hanging loop 102 can also be used to hang a completely assembled unit 112 to any type of bag.

Figure 4:
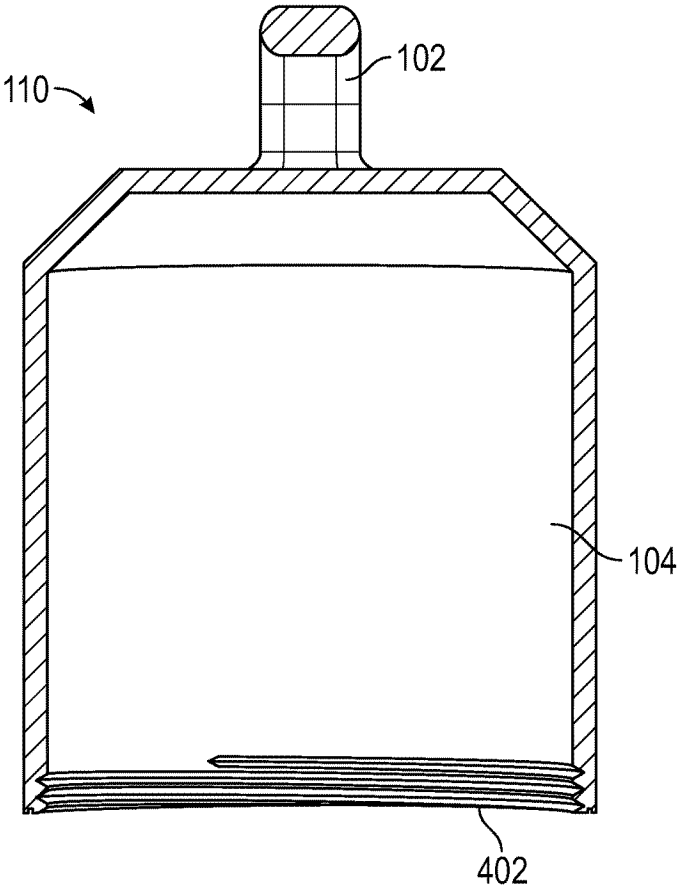
FIG. 4 illustrates a cross-sectional view of the top housing section of the sponge holder apparatus.

FIG. 4 illustrates a cross-sectional view of the top section shows the interior of the housing 104. The purpose of this housing section is to hold, contain, compress, and or store a bath sponge.

FIG. 4 also illustrates the attachment threads 402. The attachment threads facilitate the attachment of the top section 110 to the separator 106.

Figure 5:
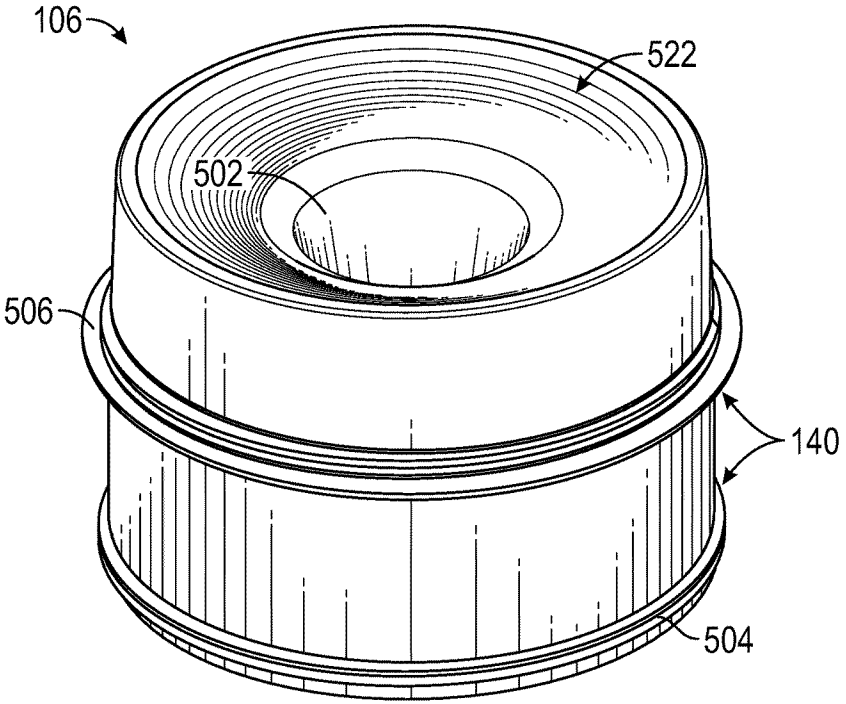
FIG. 5 illustrates a view of the middle section of the sponge holder apparatus.

FIG. 5 illustrates a view of the separator 106. The purpose of this section is to provide additional compression of the bath sponge by the action of driving the separator 106 into the top section 110. In addition, the separator 106 has a funnel design 502 to facilitate the drainage of the by-product of water and debris which is a result of the additional compression of a used bath sponge. The water and debris that are expelled from the bath sponge as it is being compressed by the separator 106 will be diverted into the drainage funnel 502. The housing attachment threads 506 will facilitate the attachment of the separator 106 to the top section 110 by creating a screw together action to join the tops section 110 to the separator 106. The base attachment threads 504 are located at the bottom of the separator 106. These threads 504 facilitate attachment to the base 108.

Figure 6:
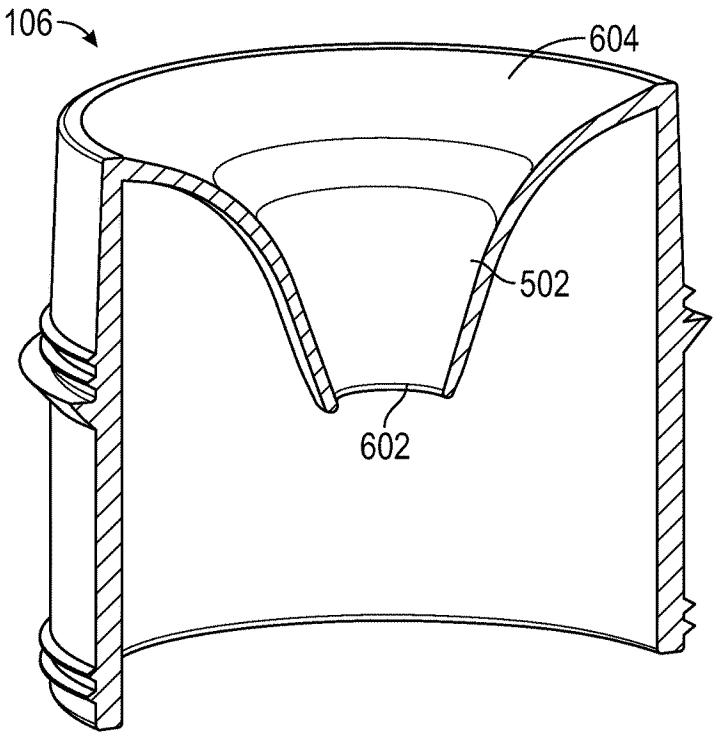
FIG. 6 illustrates a cross-sectional view of the middle section of the sponge holder apparatus.

FIG. 6 illustrates a cross-sectional view of the separator 106. This view best shows the drainage funnel 502 and the opening 602 of the drainage funnel 502. As aforementioned, the byproducts of the act of compression of a used bath sponge are water and debris. This water and debris will be expelled through the opening 602 in the drainage funnel 502. The water and debris can be held in a fully assembled bath sponge container 112 while being transported, or the water and debris can be allowed to drain into a sink or tub while the top section 110 is being suspended by the hanging loop 102. For example, the top section 110 can be attached to the separator 106 to provide additional compression of a used bath sponge and water and debris can be allowed to drain into a sink or tub.

Figure 7:
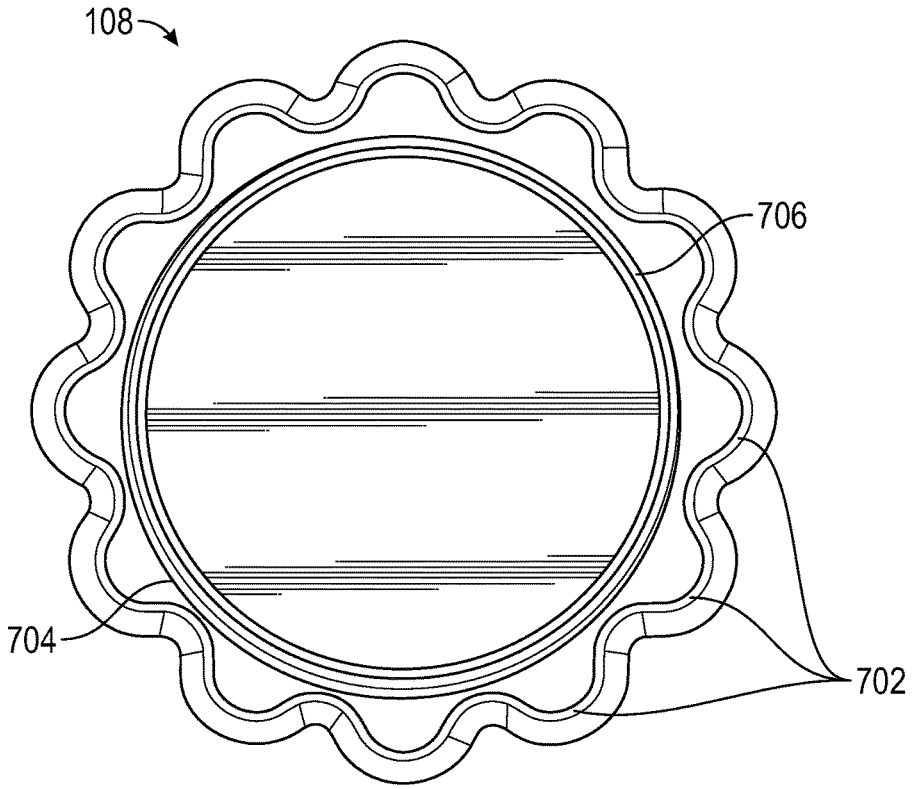
FIG. 7 illustrates a top view of the bottom section of the sponge holder apparatus.

FIG. 7 illustrates a top view of the base 108. The base 108 serves two purposes. The base 108 will allow a fully assembled bath sponge container 112 to stand independently on any smooth surface. In addition, the base 108 will serve as a reservoir for any water or debris that has been drained by the act of compressing a used bath sponge when the bath sponge container 112 is in an upright position.

As illustrated in FIG. 7, the base 108 has several bump out sections or gripping lobes 702. The purpose of the gripping lobes 702 is to provide a more secure grip on the base 108 when assembling or disassembling the bath sponge container 112.

FIG. 7 also illustrates a thin circular gasket 704. The purpose of the gasket 704 is to prevent leakage of water from the bath sponge container 112.

Figure 8:
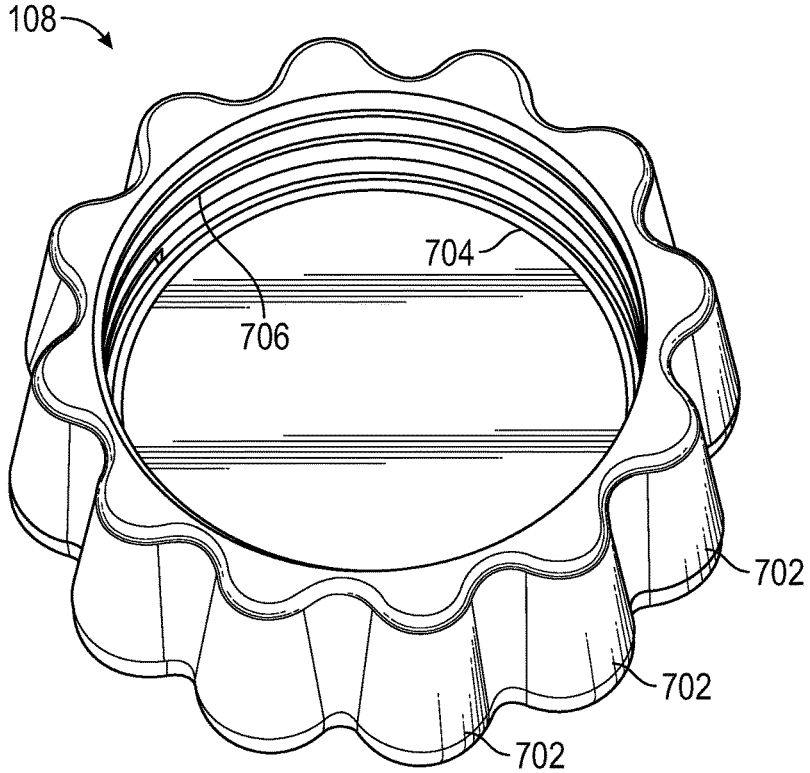
FIG. 8 illustrates an angled view of the bottom section.

FIG. 8 illustrates an additional view of the base 108 in which base attachment threads 802 may be seen. The base attachment threads 802 facilitate attachment of the base 108 to the middle section 508, which will create a fully assembled bath sponge container 112.

Figure 9:
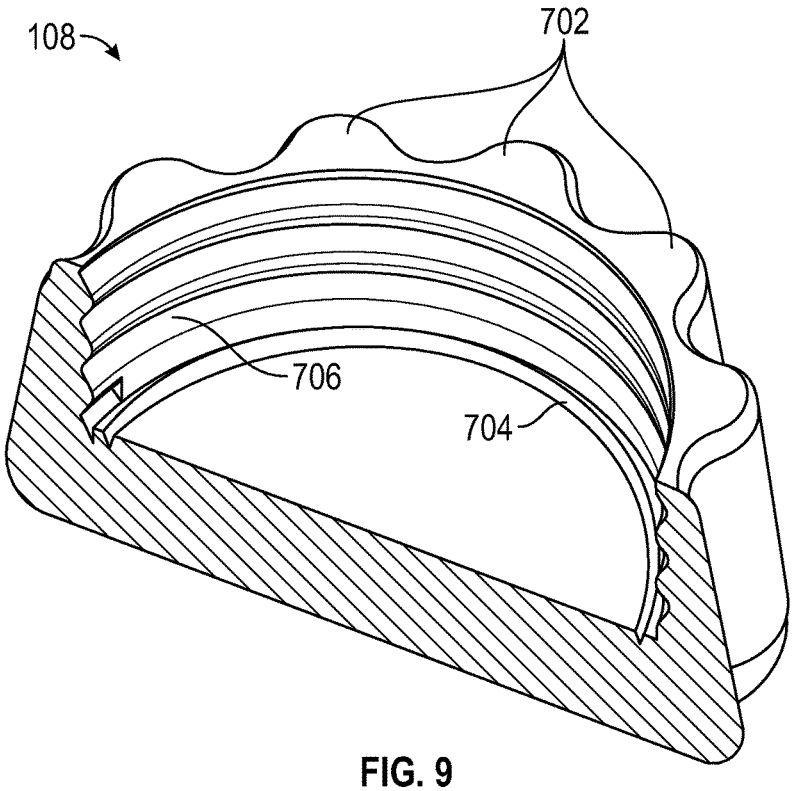
FIG. 9 illustrates a cross-sectional view of the bottom section.

FIG. 9 illustrates a cross-sectional view of the base 108. The placement of the gasket 704 can be seen as being recessed into a grooved well along the entire internal diameter of the base 108. The gasket 704 is recessed within this groove in the base 108.

Figure 10:
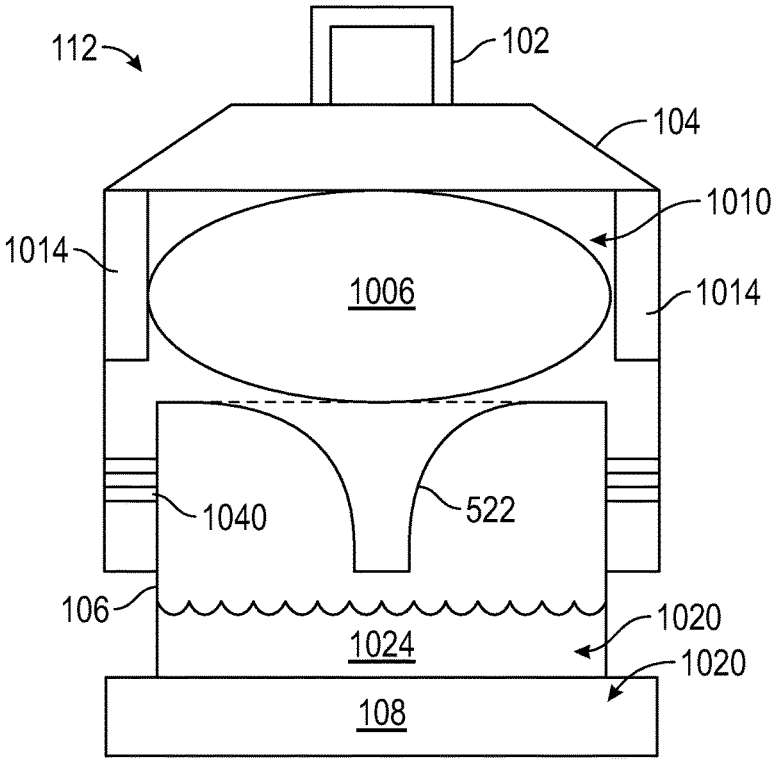
FIG. 10 is a block diagram illustrating a cross-sectional view of an assembled sponge holder apparatus.

FIG. 10 illustrates a cross-sectional view of a fully assembled bath sponge container 112. FIG. 10 illustrates a fully assembled bath sponge container 112. It also demonstrates the utility of the improved techniques, which is to contain, compress, drain, and transport a bath sponge 1006. The bath sponge container 112 includes a sponge holding space 1010 and the separator 106. The separator 106 separates the sponge holding space 1010 from a sponge draining space 1020.

The base 108 is attached to the separator 106. The attachment is facilitated by screwing together the base 108 and the separator 106 using the base attachment threads 504 (FIG. 5) and the separator attachment threads 706 (FIG. 7). The separator 106 is smaller in diameter than the top section 110, thus allowing the separator 106 to be driven up into the sponge holding space 1010. When the separator 106 is driven up as far as possible into the sponge holding space 1010, the separator 106 and the housing 104 can be attached by screwing together the attachment threads 402 (FIG. 4) and the housing attachment threads 506 (FIG. 5).

FIG. 10 illustrates the bath sponge 1006 as it is being compressed by the interior walls of the housing 1014, i.e. sponge holder 1014. The action of compression allows water and debris to be expelled from the bath sponge 1006. The water and debris, i.e., drainage 1024 is then diverted into the separator 106 and can be held in the fully assembled bath sponge container 112. The water and debris 1024 can be released from the bath sponge container 112 by unscrewing the base 108 from the separator 106 while holding over a sink or bath tub and allowing water and debris 1024 to drain.

Figure 11:
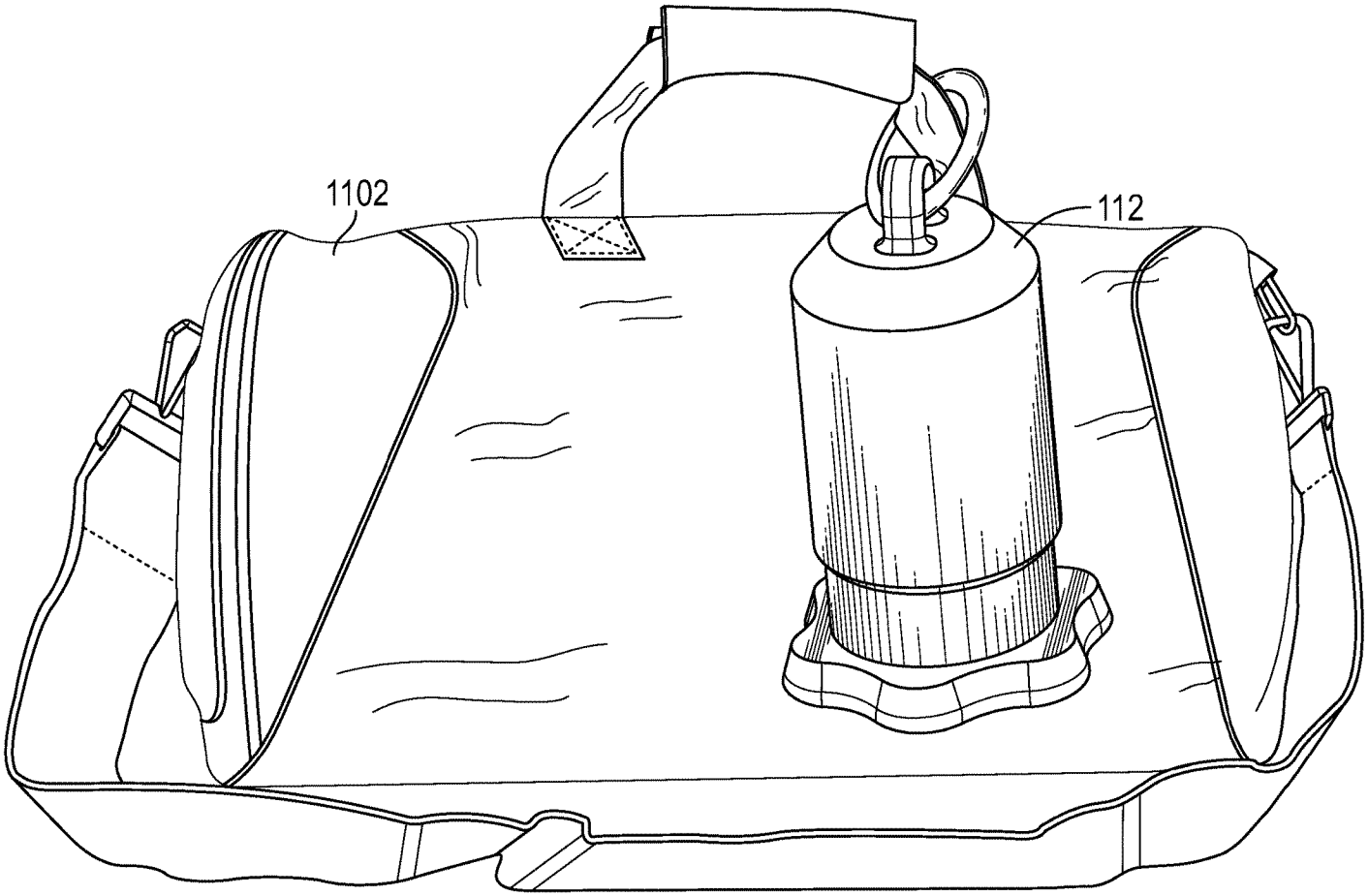
FIG. 11 illustrates a view of an assembled sponge holder apparatus as it hangs on a travel bag.

FIG. 11 illustrates an alternate embodiment of a fully assembled bath sponge container 112 hanging on a travel bag.

Figure 12:
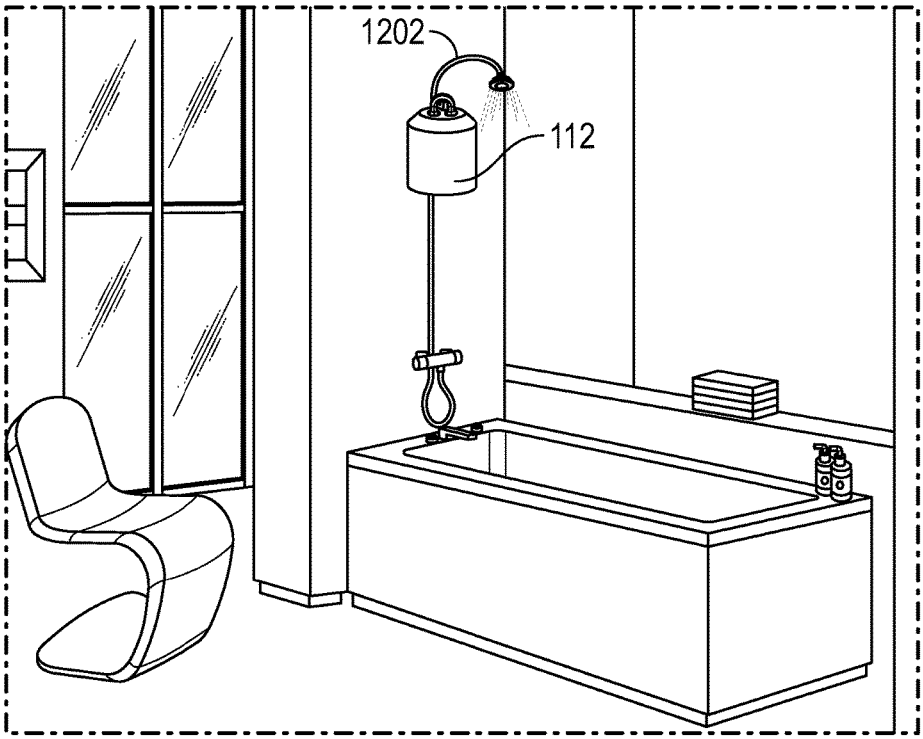
FIG. 12 illustrates a view of the top section of the sponge holder apparatus in an alternate embodiment as it hangs suspended by the hanging loop in a shower.

FIG. 12 illustrates an alternate embodiment of the bath sponge container as only the top section 110 is being suspended by the hanging loop 102 in a shower enclosure with a bath sponge 1006 being held and compressed by the housing 104.

Figure 13:
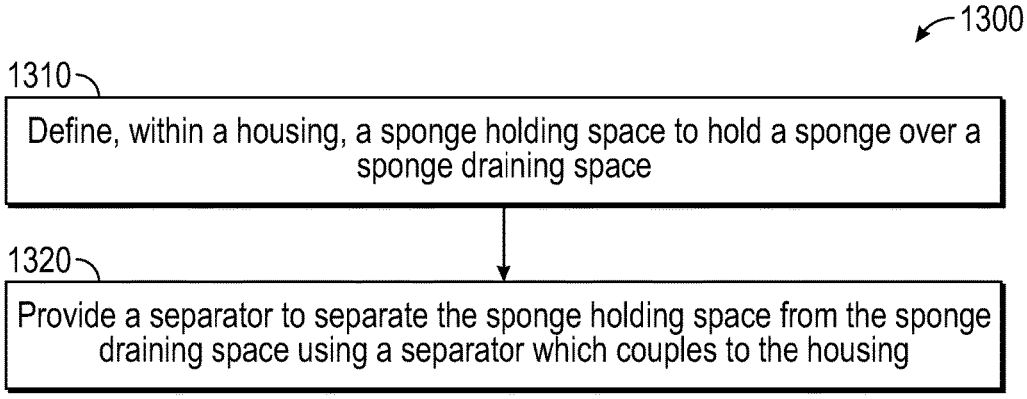
FIG. 13 is a flow chart illustrating an example method of manufacturing a sponge holding apparatus according to the improved techniques.

FIG. 13 illustrates an example method 1300 of manufacturing a sponge holding apparatus. At 1302, a sponge holding space is defined within a housing to hold a sponge over a sponge draining space. At 1304, a separator is provided to separate the sponge holding space from the sponge draining space using a separator which couples to the housing.

The aforementioned bath sponge container 112 may be fabricated from any number of different plastics, metals, composites, and the like, and any combinations thereof, depending upon the requirements of particular applications of the invention. Materials employed in the fabrication of the bath sponge container 112 are preferably suitable for exposure to water, but if materials are employed which are affected by water, such as wood, certain metals (e.g., iron, aluminum, brass), and the like, then a conventional protective coating is preferably applied to the surface of the material to protect it from water.

It is understood that the present invention may take many forms and embodiments. Accordingly several variations may be made in the foregoing without departing from the spirit or scope of the invention. For example a variety of sizes—smaller or larger than those illustrated in the Figures—could be fabricated to accommodate the storage, compression and drainage of any number of sponges for home, commercial, and personal use. In additional the present invention could be fabricated to accommodate any number of wet articles of clothing that require transportation, such as bathing suit, swim suits, and wet suits.

As an additional example, the number of petals in the gripping lobes 702 of the base 108 as illustrated in FIGS. 7-9 is 12, which is preferred. However, there may be any number of petals in the gripping lobes 702, e.g., 4, 5, 6, 7, 8, 9, 10, 11, 12, and higher.

As a further example, the separator 106 as illustrated in the Figures does not have a gasket; only the base 108 has a gasket. However, in some arrangements, the separator may have a gasket to further prevent fluids from escaping the container 112.

Having thus described the present invention by reference to certain of its preferred embodiments, it is noted that the embodiments disclosed are illustrative rather than limiting in nature and that a wide range of variations, modifications, changes and substitutions are contemplated in the foregoing disclosure and, in some instances, some features of the present invention may be employed without corresponding use of the other features. Many such variations and modifications may be considered obvious and desirable by those skilled in the art based upon review of the foregoing description of preferred embodiments. Accordingly, it is appropriate that the appended claims be constructed broadly and in a manner consistent with the scope of the invention.

Further, although features are shown and described with reference to particular embodiments hereof, such features may be included and hereby are included in any of the disclosed embodiments and their variants. Thus, it is understood that features disclosed in connection with any embodiment are included as variants of any other embodiment.

As used throughout this document, the words "comprising," "including," and "having" are intended to set forth certain items, steps, elements, or aspects of something in an open-ended fashion. Also, as used herein and unless a specific statement is made to the contrary, the word "set" means one or more of something. This is the case regardless of whether the phrase "set of" is followed by a singular or plural object and regardless of whether it is conjugated with a singular or plural verb. Although certain embodiments are disclosed herein, it is understood that these are provided by way of example only and the invention is not limited to these particular embodiments.

Those skilled in the art will therefore understand that various changes in form and detail may be made to the embodiments disclosed herein without departing from the scope of the invention.

What is claimed is:

1. An article holding apparatus comprising:

a housing which defines a holding space to hold a wet article over a draining space;

a separator which couples to the housing, the separator being constructed and arranged to separate the holding space from the draining space;

a base which couples to the separator at an end of the separator facing the draining space, the base providing an enclosure around the draining space; and a loop assembly including a loop attached to a top end of the housing, the loop assembly being constructed and arranged to support the article holding apparatus in an upright position as the loop assembly is supported externally by the loop, wherein the separator further includes a base coupling portion which is constructed and arranged to couple to the base, and wherein the separator includes (i) a housing coupling portion which is constructed and arranged to couple the separator to the housing and (ii) a guiding portion which is constructed and arranged to guide fluid from the holding space to the draining space, wherein the housing, the separator, and the base together form a closed container, wherein the separator has an external sidewall extending around the separator, and wherein the guiding portion includes a funnel extending inwardly from the external sidewall and downwardly toward the draining space, the funnel having (i) a first end having a first width and facing the holding space and (ii) a second end having a second width and facing the draining space, the second width being smaller than the first width.

2. An article holding apparatus as in claim 1, wherein the separator fits inside the housing;

wherein housing coupling portion of the separator is located on an outside surface of the separator; and wherein the housing coupling portion of the separator includes attachment threads which enable the coupling of the separator to an inner surface of the housing by a screwing motion.

3. An article holding apparatus as in claim 1, wherein the base includes (i) a separator coupling portion which is constructed and arranged to couple the base to the separator and (ii) a sealing portion which is constructed and arranged to contain fluid from the wet article within the apparatus.

4. An article holding apparatus as in claim 3, wherein the separator coupling portion includes attachment threads on an interior surface of the base, the attachment threads enabling the coupling of the base to an outer surface of the separator by a screwing motion.

5. An article holding apparatus as in claim 3, wherein the sealing portion of the base includes a gasket located in an interior surface of the base, the gasket being recessed into a grooved well in the base along a circumference of the base.

6. An article holding apparatus as in claim 3, wherein the base further includes a set of gripping lobes arranged circumferentially around an exterior surface of the base, each of the set of gripping lobes radially protruding from the base and having a rounded edge away from the base.

7. An article holding apparatus as in claim 1, wherein, when the funnel is coupled to the separator, the funnel is disposed at least partially within the housing to provide compression to the wet article.

8. A method of manufacturing an article holding apparatus, the method comprising:

defining, within a housing, a holding space to hold a wet article over a draining space;

providing a separator to separate the holding space from the draining space using a separator which couples to the housing, the separator having an external sidewall extending around the separator;

providing an enclosure around the draining space using a base which couples at an end of the separator facing the draining space;

providing a loop assembly including a loop attached to a top end of the housing, the loop assembly being constructed and arranged to support the article holding apparatus in an upright position as the loop assembly is supported externally by the loop, wherein providing the separator includes:

defining a housing coupling portion which is constructed and arranged to couple the separator to the housing; and defining a guiding portion within the separator, the guiding portion being constructed and arranged to guide fluid from the holding space to the draining space, and wherein defining the guiding portion includes providing a funnel extending inwardly from the external sidewall and downwardly toward the draining space, the funnel including (i) a first end having a first width and facing the holding space and (ii) a second end having a second width and facing the draining space, the second width being smaller than the first width.

9. A method as in claim 8, wherein providing the enclosure includes:

defining a separator coupling portion which is constructed and arranged to couple the base to the separator; and defining a sealing portion which is constructed and arranged to contain fluid from the wet article within the apparatus.

10. A method as in claim 9, wherein defining the separator coupling portion includes providing attachment threads on an interior surface of the base, the attachment threads enabling the coupling of the base to an outer surface of the separator by a screwing motion.

11. A method as in claim 9, wherein defining the sealing portion includes a providing gasket located in an interior surface of the base, the gasket being recessed into a grooved well in the base along a circumference of the base.

12. A method as in claim 9, wherein providing the enclosure further includes providing a set of gripping lobes arranged circumferentially around an exterior surface of the base, each of the set of gripping lobes radially protruding from the base and having a rounded edge away from the base.

13. A method of containing a wet article, the method comprising:

providing a housing that defines a holding space to hold a wet article over a draining space;

providing a separator constructed and arranged to separate the holding space from the draining space, the separator having an external sidewall and a funnel extending inwardly from the external sidewall and downwardly toward the draining space; and coupling the separator to the housing with a wet article placed in the housing, such that, when the housing is positioned upright with the housing above the separator, liquid drains from the wet article, through the funnel in the separator, and into the draining space, wherein coupling the separator to the housing compresses the wet article and causes liquid to drain from the wet article.

14. A method as in claim 13, wherein the method further comprises attaching a base to the separator, the base forming a leak-resistant seal with the separator and catching liquid draining into the draining space.

* * * * *